US009846445B2

(12) United States Patent
Pigott et al.

(10) Patent No.: US 9,846,445 B2
(45) Date of Patent: Dec. 19, 2017

(54) VOLTAGE SUPPLY REGULATOR WITH OVERSHOOT PROTECTION

(71) Applicant: FREESCALE SEMICONDUCTOR, INC., Austin, TX (US)

(72) Inventors: John M. Pigott, Phoenix, AZ (US); Valerian Mayega, Tempe, AZ (US); Hang Fung Yip, Chandler, AZ (US)

(73) Assignee: NXP USA, Inc., Austin, TX (US)

( * ) Notice: Subject to any disclaimer, the term of this patent is extended or adjusted under 35 U.S.C. 154(b) by 0 days.

(21) Appl. No.: 15/134,512

(22) Filed: Apr. 21, 2016

(65) Prior Publication Data

US 2017/0308108 A1 Oct. 26, 2017

(51) Int. Cl.

| | |
|---|---|
| ***G05F 1/571*** | (2006.01) |
| ***G05F 1/575*** | (2006.01) |
| ***G05F 1/56*** | (2006.01) |
| *G05F 1/569* | (2006.01) |

(52) U.S. Cl.

CPC ..... *G05F 1/571* (2013.01); *G05F 1/562* (2013.01); *G05F 1/575* (2013.01); *G05F 1/569* (2013.01)

(58) Field of Classification Search

CPC . G05F 1/56; G05F 1/562; G05F 1/569; G05F 1/571; G05F 1/575

See application file for complete search history.

(56) References Cited

U.S. PATENT DOCUMENTS

| | | | | |
|---|---|---|---|---|
| 5,617,051 | A | 4/1997 | Bingham | |
| 5,929,616 | A * | 7/1999 | Perraud | G05F 1/569 323/274 |
| 6,016,245 | A | 1/2000 | Ross | |
| 6,300,815 | B1 | 10/2001 | Hintercher et al. | |
| 6,853,565 | B1 | 2/2005 | Liao | |
| 6,979,984 | B2 | 12/2005 | Perrier et al. | |
| 8,716,993 | B2 * | 5/2014 | Kadanka | G05F 1/56 323/274 |
| 9,323,262 | B2 * | 4/2016 | Tomioka | G05F 1/56 |
| 2007/0030054 | A1 * | 2/2007 | Lee | G05F 1/571 327/541 |
| 2008/0186644 | A1 * | 8/2008 | Migliavacca | G05F 1/571 361/86 |
| 2008/0231240 | A1 * | 9/2008 | Parkes, Jr. | G05F 1/571 322/28 |
| 2013/0285631 | A1 * | 10/2013 | Bisson | G05F 1/575 323/280 |

(Continued)

FOREIGN PATENT DOCUMENTS

| | | |
|---|---|---|
| CN | 103699168 A | 4/2014 |

*Primary Examiner* — Fred E Finch, III

(57) ABSTRACT

A voltage supply regulator includes a first output resistor including a first terminal coupled to an output voltage of the voltage supply regulator and a second terminal; a first comparator including a first input coupled to a reference voltage, a second input coupled to the second terminal of the first output resistor, and an output coupled to a base of a first regulator transistor; a current mirror coupled to a collector of the first regulator transistor; and an slew rate detector coupled to the current mirror that includes a first terminal coupled to control electrodes of first and second transistors in the current mirror, and a detection bipolar junction transistor having a collector coupled to the control electrodes of the first and second transistors in the current mirror, and a base coupled to a second terminal of the capacitor.

19 Claims, 1 Drawing Sheet

(56) References Cited

U.S. PATENT DOCUMENTS

| | | | | |
|---|---|---|---|---|
| 2014/0354249 | A1* | 12/2014 | Kurozo | G05F 1/575 323/271 |
| 2015/0188423 | A1* | 7/2015 | Tomioka | G05F 1/571 323/282 |
| 2015/0346750 | A1* | 12/2015 | Bhattad | G05F 1/575 323/280 |
| 2015/0378379 | A1* | 12/2015 | Bhattad | G05F 1/575 323/280 |
| 2017/0068264 | A1* | 3/2017 | Kurnaz | G05F 1/575 |

* cited by examiner

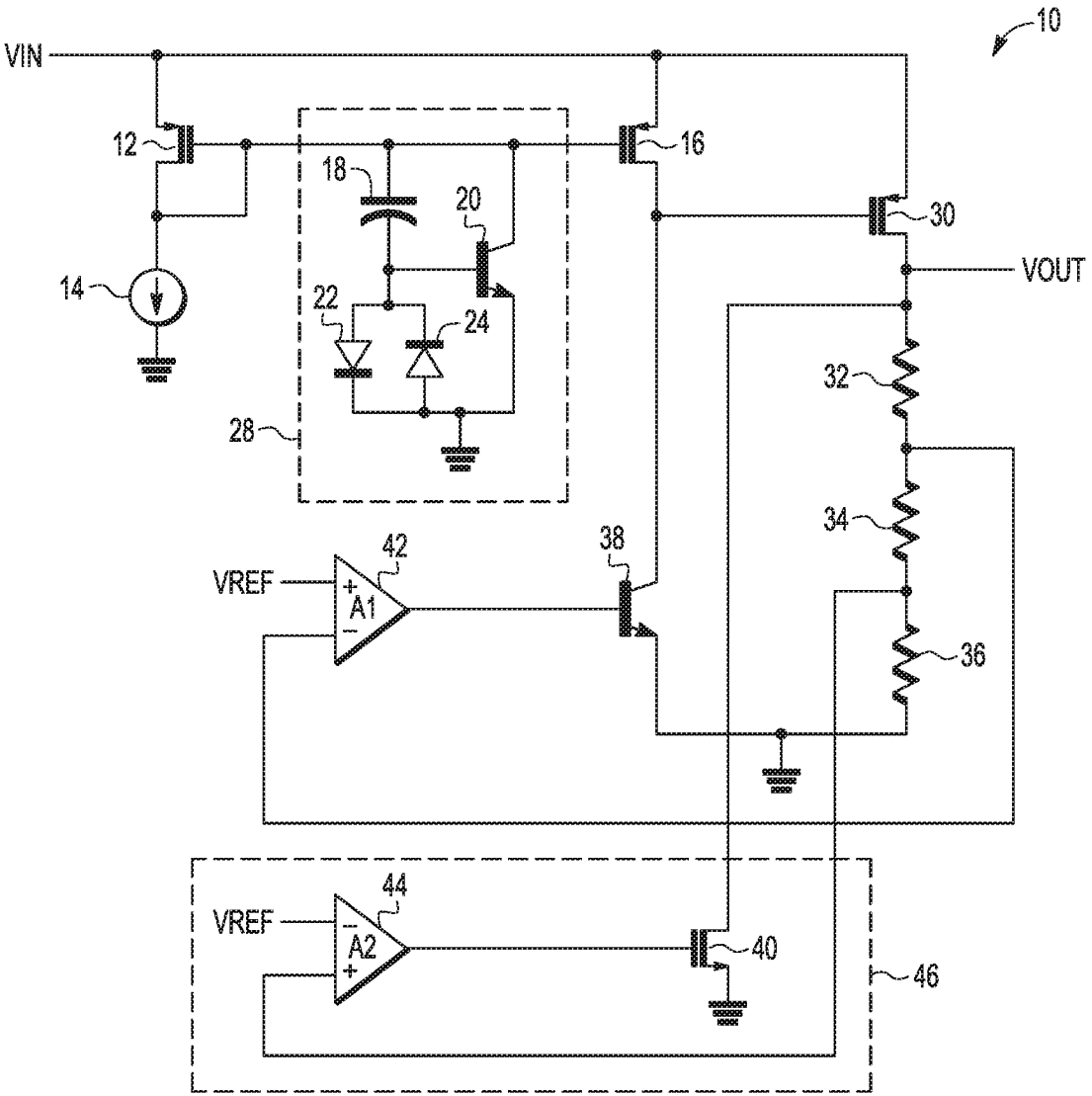
10
VIN
12
14
16
18
20
22
24
28
30
VOUT
32
34
36
38
40
42
A1
VREF
44
A2
VREF
46

VOLTAGE SUPPLY REGULATOR WITH OVERSHOOT PROTECTION

BACKGROUND

Field

This disclosure relates generally to voltage regulators, and more specifically, to voltage regulators with overshoot protection.

Related Art

A low drop-out (LDO) voltage regulator is a DC linear regulator that can regulate the output voltage to a target voltage even when the input supply voltage is very close to the output voltage. Black-out and brown-out conditions describe a scenario in which the input supply voltage starts from 0V (in the case of a black-out condition) or some intermediate voltage (in the case of a brown-out condition) and quickly rises to its high target value. In these conditions, the regulator may be unable to respond appropriately and its output regulated voltage supply may overshoot and exceed specification. This may result in exceeding the safe operating area (SOA) of devices supplied by the regulator. Therefore, a need exists for a voltage regulator which suppresses overshoot at the regulated output.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

FIG. 1 illustrates, in schematic form, a voltage regulator in accordance with an embodiment of the present invention.

DETAILED DESCRIPTION

A voltage regulator with overshoot suppression circuitry includes a slew rate detector and a sink circuit. The slew rate detector is configured to detect a fast rise in the input voltage supply and, in response, ensure that the pass transistor of the regulator is shut off to reduce or eliminate the overshoot. Furthermore, the suppression circuitry may include a sink circuit configured to, upon the regulated output voltage overshooting to a predetermined amount above the target voltage, turn on a current sink to quickly pull down the regulated output voltage.

FIG. 1 illustrates, in schematic form, a voltage regulator 10 in accordance with one embodiment of the present invention. Regulator 10 is an LDO linear regulator, and includes PMOS transistors 12 and 16, a PMOS pass transistor 30, a current source 14, an slew rate detector 28, an operational amplifier (opamp) 42, an NPN bipolar junction transistor 38 (also referred to as a regulator transistor), resistors 32, 34, and 36, and a sink circuit 46. Input voltage rate detector 28 includes a capacitor 18, an NPN bipolar junction transistor 20 (also referred to as a detection bipolar junction transistor), and diodes 22 and 24. Sink circuit 46 includes a comparator 44 (also referred to as an opamp) and an NMOS transistor 40. Regulator 10 receives an input supply voltage at an input node, Vin, and provides an output regulated voltage supply at an output node, Vout. Regulator 10 also receives a reference voltage Vref.

A first current electrode of transistor 12 is coupled to Vin and a second current electrode of transistor 12 is coupled to a first terminal of current source 14. A second terminal of current source 14 is coupled to ground. A control electrode of transistor 12 is coupled to the second current electrode of transistor 12, a first terminal of capacitor 18, a collector of transistor 20, and a control electrode of transistor 16. A second electrode of capacitor 18 is coupled to a base of transistor 20, a cathode of diode 24, and an anode of diode 22. An anode of diode 24, a cathode of diode 22, and an emitter electrode of transistor 20 are coupled to ground. A first current electrode of transistor 16 is coupled to Vin and a first current electrode of transistor 30 is coupled to Vin. A second current electrode of transistor 16 is coupled to a gate electrode of transistor 30 and a collector electrode of transistor 38. A second current electrode of transistor 30 is coupled to Vout and to a first terminal of resistor 32. A second terminal of resistor 32 is coupled to a first terminal of resistor 34, and a second terminal of resistor 34 is coupled to a first terminal of resistor 36. A second terminal of resistors 36 is coupled to ground. A positive input of opamp 42 is coupled to receive Vref and a negative input of opamp 42 is coupled to the second terminal of resistor 32. An output of opamp 42 is coupled to a base electrode of transistor 38, and an emitter electrode of transistor 38 is coupled to ground. A negative input of comparator 44 is coupled to receive Vref and a positive input of comparator 44 is coupled to a first terminal of resistor 36. A first current electrode of transistor 40 is coupled to Vout, a control electrode of transistor 40 is coupled to an output of comparator 44, and a second current electrode of transistor 40 is coupled to ground. Resistors 32, 34, 36 form a resistor divider in which the resistors are coupled in series and which may include additional resistors, as needed.

In operation, regulator 10 receives Vin and regulates to achieve a regulated output at a target voltage. Slew rate detector circuit 28 is not activated until a first threshold or trigger is reached. In the illustrated embodiment, slew rate detector circuit is activated when the base-emitter voltage (Vbe) of transistor 20 exceeds 0.7V. Therefore, as long as Vbe does not exceed 0.7, transistor 20 has little effect on voltage regulator 10. Similarly, sink circuit 46 remains inactive until a second threshold or trigger is reached, set by the positive input of comparator 44 and resistors 32, 34, and 36. In the illustrated embodiment, the positive input of comparator 44 is coupled to a node between resistors 34 and 36. While the voltage at the positive input of comparator 44 remains below Vref, the output of comparator 44 remains low, keeping transistor 40 off and thus keeping sink circuit 46 inactive.

While circuits 28 and 46 are deactivated, regulator 10 operates as a normal regulator. Transistors 12 and 16 and current source 14 operate as a current mirror which provides current to transistor 38. Pass transistor 30 is turned on, and Vout is regulated by the feedback loop from the second terminal of resistor 32 to the negative input of opamp 42. If the voltage at the negative input of opamp 42 is greater than Vref, the output of opamp 42 turns off, decreasing the current sunk by transistor 38, which decreases Vout. If the voltage at the negative input of opamp 42 is less then Vref, the output of opamp 42 turns on, increasing the current sunk by transistor 38, allowing Vout to increase. Through this feedback loop, Vout can achieve and maintain its target voltage in normal operation.

During normal operation, when the Vin slew rate is lower than a certain threshold, slew rate detector 28 is not active, and diodes 22 and 24 pull the base of transistor 20 to near 0V, keeping transistor 20 off. The threshold for activation of slew rate detector 28 depends on the capacitance of capacitor 18, the parameters of diodes 22 and 24, and the Vbe of transistor 20. The voltage at the first terminal of capacitor 18 is the voltage at Vin minus the gate-source voltage of transistor 12 (about Vin—0.8). The voltage at the second terminal of capacitor 18 is approximately 0V. Therefore, there is a voltage across capacitor 18. When the Vin voltage rises by at least a certain amount (0.7V in the current embodiment) in a relatively short amount of time, this voltage change is coupled through capacitor 18 and appears on the base of transistor 20. This turns on transistor 20 and activates slew rate detector 28. During normal operation, transistor 16 supplies a small current, however, when transistor 20 turns on, the control electrode of transistor 16 is pulled down, thus turning transistor 16 on harder to provide more current, exceeding the current provided by transistor 38. This causes transistor 30 to turn off and thus reduce or eliminate the output overshoot due to the fast transient. Therefore, when slew rate detector 28 is activated by turning on transistor 20, transistor 16 is turned on harder and transistor 30 is turned off strongly. The rise in input voltage at Vin eventually terminates causing the voltage at the base of transistor 20 to fall below the first threshold (e.g. 0.7V) and again deactivating slew rate detector 28 and allowing transistor 38 to again regulate Vout normally. Note that without slew rate detector 28, if an overshoot occurs, it is difficult to turn off transistor 30 due to its parasitic capacitances, especially that between its gate and drain. However, by activating capacitor 18, transistor 20, and transistor 16, transistor 30 can be turned off quickly under a fast transient condition, this limiting the magnitude of overshoot that occurs.

If Vout does actually exceed the target reference voltage by a predetermined amount or offset, the output of comparator 44 turns on transistor 40 which sinks current from Vout, keeping Vout at safe levels. When Vout again reaches safe levels and falls below the second threshold, transistor 40 is kept off to not affect regulator 10. The offset over the target reference voltage needed to activate sink circuit 46 by turning on transistor 40 is set by the values of resistors 34 and 36. In one embodiment, resistor 34 has a resistance that is about 4-6%, or 5%, that of resistor 36. The values can be set accordingly depending on the desired offset from the target voltage for activating sink circuit 46.

In one example, the voltage at Vin is 5V+1-10% and an overshoot condition occurs if the input voltage supply rises quickly and exceeds 6.5V. In this example, the target voltage for Vout is 4.4V, and the downstream devices can handle a maximum of 4.8V DC. During a blackout (when Vin starts from 0V and can reach 5V or 6.5V) or a brownout (when Vin starts at some mid voltage, such as 2V), overshoot on Vout (especially for the case in which Vin reaches 6.5V) needs to be avoided. Vref, in this example, is around 1.2V and resistors 32, 34, and 36 are values that cause Vout to be regulated at 4.4V. In one example, resistor 32 is about 267 kohms, resistor 34 is about 5 kohms, and resistor 36 is about 95 kohms which produces regulation by opamp 42 which results in regulated Vout being at 4.4V, which is below 4.8V. In this example, the resistor values also cause comparator 44 to activate by sinking current when Vout exceeds 4.7V.

In alternate embodiments, different circuit elements can be used within slew rate detector 28 and different resistors or other circuit elements can be used to set different threshold values for activating slew rate detector 28 or sink circuit 46. Also, different circuitry or additional circuitry may be used to implement the portion of voltage regulator 10 that regulates Vout during normal operation.

By now it should be appreciated that there has been provided a circuit which handles various overshoot conditions which may occur at various times during operation. For example, they may be caused by blackout or brownout events. In one embodiment, a slew rate detector is activated at a first threshold to reduce or eliminate an overshoot condition. In another embodiment, a sink circuit is activated at a second threshold to pull down the regulated output in the case of an overshoot condition.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention has been described with respect to specific conductivity types or polarity of potentials, skilled artisans appreciated that conductivity types and polarities of potentials may be reversed.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Those skilled in the art will recognize that boundaries between the functionality of the above described operations merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

Although the invention is described herein with reference to specific embodiments, various modifications and changes can be made without departing from the scope of the present invention as set forth in the claims below. For example, MOS transistors can be used in place of the bipolar junction transistors. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

The term "coupled," as used herein, is not intended to be limited to a direct coupling or a mechanical coupling.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

The following are various embodiments of the present invention.

An embodiment of the present invention relates to a voltage supply regulator which includes a first output resistor including a first terminal coupled to an output voltage of the voltage supply regulator and a second terminal; a first opamp including a first input coupled to a reference voltage, a second input coupled to the second terminal of the first output resistor, and an output coupled to a base of a first regulator transistor; a current mirror coupled to a collector of the first regulator transistor; a slew rate detector coupled to the current mirror, wherein the slew rate detector includes a capacitor including a first terminal coupled to control electrodes of first and second transistors in the current mirror, and a detection bipolar junction transistor including a collector coupled to the control electrodes of the first and second transistors in the current mirror, and a base coupled to a second terminal of the capacitor. In one aspect, the regulator further includes a second output resistor coupled in series with the first output resistor; and a third output resistor coupled in series with the second output resistor. In a further aspect, the regulator further includes a first comparator including a first input coupled to the reference voltage and a second input coupled to a junction between the second and third resistors. In yet a further aspect, the regulator further includes a second regulator transistor including a control electrode coupled to an output of the first comparator, a first current electrode coupled to the output voltage, and a second current electrode coupled to ground. In another further aspect, the regulator further includes a first current electrode of the second transistor of the current mirror is coupled to an input voltage; and the collector of the first regulator transistor is coupled to the current mirror at a second current electrode of the second transistor of the current mirror. In another further aspect, the regulator further includes an emitter of the first regulator transistor coupled to ground at an output terminal of the third resistor. In another aspect, the slew rate detector further includes a first diode and a second diode, the first diode having an input terminal coupled to the second terminal of the capacitor and an output terminal coupled to an input terminal of the second diode, and an output terminal of the second diode is coupled to the input terminal of the first diode and the second terminal of the capacitor.

Another embodiment relates to a voltage supply regulator which includes a current mirror coupled to receive an input voltage in which the current mirror includes a first transistor having a first current electrode coupled to the input voltage, a second current electrode coupled to a first terminal of a current source, and a gate electrode coupled to the second electrode; and a second transistor having a first current electrode coupled to the input voltage, a second current electrode coupled to a collector of a third transistor, and a gate electrode coupled to the gate electrode of the first transistor. The voltage regulator also includes a comparator; a first regulator transistor including a first current electrode coupled to the second current electrode of the pass transistor, a second current electrode coupled to ground, and a gate electrode coupled to an output of the comparator; an opamp; a resistor divider; a second regulator transistor including a base coupled to an output of the opamp, a collector coupled to the second current electrode of the second transistor, and an emitter coupled to an ending terminal of the resistor divider. In one aspect, the regulator further includes a pass transistor including a first current electrode coupled to the input voltage and the first current electrodes of the first and second transistors, a second current electrode coupled to a beginning terminal of the resistor ladder and to provide a regulated output voltage, and a gate electrode coupled to the second electrode of the second transistor and a collector of the second regulator transistor. In a further aspect, the resistor divider includes a plurality of resistors coupled in series between the beginning terminal and the ending terminal; the opamp includes a first input coupled to a reference voltage and a second input coupled between a first and a second one of the plurality of resistors. In a further aspect, the regulator further includes a slew rate detector including: a capacitor including a first terminal coupled to the gate electrodes of the first and second transistors and a second terminal coupled to a first terminal of the activation threshold circuit; a bipolar junction transistor including a collector coupled to the gate electrodes of the first and second transistors, a base coupled to a second terminal of the capacitor. In another further aspect, the comparator includes a first input coupled to the reference voltage and a second input coupled between the second one of the plurality of resistors and a third one of the plurality of resistors. In another aspect, the slew rate detector includes a first diode and a second diode, the first diode having an input terminal coupled to the second terminal of the capacitor and an output terminal coupled to an input terminal of the second diode, and an output terminal of the second diode is coupled to the input terminal of the first diode and the second terminal of the capacitor. In another aspect, the first, second, and pass transistors are PMOS transistors. In a further aspect, the first regulator transistor is an NMOS transistor. In another aspect, the bipolar junction transistor and the second regulator transistor are NPN bipolar junction transistors. In another aspect, resistance of the second resistor is between 6 and 15 percent of resistance of the third resistor.

Yet another embodiment relates to a voltage supply regulator which includes a slew rate detector between control electrodes of two transistors in a current mirror, wherein inputs to the current mirror are coupled to an input voltage (VIN) and the slew rate detector includes a pair of diodes coupled back-to-back with one another; a capacitor including a first terminal coupled to the control electrodes of first and second transistors in the current mirror, and a second terminal coupled to a first terminal of the pair of diodes; and a detection bipolar junction transistor including a collector coupled to the gate electrodes of the first and second transistors in the current mirror, a base coupled to a second terminal of the capacitor and the first terminal of the pair of diodes, and an emitter coupled to a second terminal of the pair of diodes. The voltage regulator also includes a current source coupled to a second current electrode of a first of the two transistors in the current mirror; first, second and third resistors coupled in series; and a first regulator transistor having a collector coupled to the second current electrode of the second one of the two transistors of the current mirror, a base coupled to an output of a first opamp, and an emitter coupled to an output terminal of the third resistor. In one aspect, the regulator further includes a pass transistor having: a first current electrode coupled to respective first current electrodes of the two transistors of the current mirror and the input voltage, a control electrode coupled to a second current electrode of a second one of the two transistors of the current mirror, and a second current electrode coupled to a first terminal of the first resistor; and an output voltage terminal coupled to the second current electrode of the pass transistor. In another aspect, the first opamp includes a first input coupled to a reference voltage, a second input coupled between the first and second resistors, and an output coupled to a base of a first regulator transistor; a first comparator includes a first input coupled to the reference voltage, a second input coupled between the second and third resistors, and an output coupled to a second regulator transistor; and the second regulator transistor further includes a first current electrode coupled to the output voltage terminal, a second current electrode coupled to ground.

What is claimed is:

1. A voltage supply regulator, comprising:

a first output resistor including a first terminal coupled to an output voltage of the voltage supply regulator and a second terminal;

a first opamp including a first input coupled to a reference voltage, a second input coupled to the second terminal of the first output resistor, and an output coupled to a base of a first regulator transistor;

a current mirror coupled to a collector of the first regulator transistor;

a slew rate detector coupled to the current mirror, wherein the slew rate detector includes:

a capacitor including a first terminal coupled to control electrodes of first and second transistors in the current mirror; and a detection bipolar junction transistor including a collector coupled to the control electrodes of the first and second transistors in the current mirror, and a base coupled to a second terminal of the capacitor.

2. The voltage supply regulator of claim 1, further comprising:

a second output resistor coupled in series with the first output resistor; and a third output resistor coupled in series with the second output resistor.

3. The voltage supply regulator of claim 2, further comprising:

a first comparator including a first input coupled to the reference voltage and a second input coupled to a junction between the second and third resistors.

4. The voltage supply regulator of claim 3, further comprising:

a second regulator transistor including a control electrode coupled to an output of the first comparator, a first current electrode coupled to the output voltage, and a second current electrode coupled to ground.

5. The voltage supply regulator of claim 2, further comprising:

a first current electrode of the second transistor of the current mirror is coupled to an input voltage; and the collector of the first regulator transistor is coupled to the current mirror at a second current electrode of the second transistor of the current mirror.

6. The voltage supply regulator of claim 2, further comprising:

an emitter of the first regulator transistor coupled to ground at an output terminal of the third resistor.

7. The voltage supply regulator of claim 1, the slew rate detector further comprising:

a first diode and a second diode, the first diode having an input terminal coupled to the second terminal of the capacitor and an output terminal coupled to an input terminal of the second diode, and an output terminal of the second diode is coupled to the input terminal of the first diode and the second terminal of the capacitor.

8. A voltage supply regulator, comprising:

a current mirror coupled to receive an input voltage, the current mirror including:

a first transistor having a first current electrode coupled to the input voltage, a second current electrode coupled to a first terminal of a current source, and a gate electrode coupled to the second electrode;

a second transistor having a first current electrode coupled to the input voltage, a second current electrode, and a gate electrode coupled to the gate electrode of the first transistor;

a comparator;

a first regulator transistor including a first current electrode, a second current electrode coupled to ground, and a gate electrode coupled to an output of the comparator;

an opamp;

a resistor divider;

a second regulator transistor including a base coupled to an output of the opamp, a collector coupled to the second current electrode of the second transistor, and an emitter coupled to an ending terminal of the resistor divider;

a slew rate detector including:

a capacitor including a first terminal coupled to the gate electrodes of the first and second transistors;

a bipolar junction transistor including a collector coupled to the gate electrodes of the first and second transistors and a base coupled to a second terminal of the capacitor.

9. The voltage supply regulator of claim 8, further comprising:

a pass transistor including a first current electrode coupled to the input voltage and the first current electrodes of the first and second transistors, a second current electrode coupled to a beginning terminal of the resistor divider and to provide a regulated output voltage, and a gate electrode coupled to the second electrode of the second transistor and the collector of the second regulator transistor.

10. The voltage supply regulator of claim 9, wherein:

the resistor divider includes a plurality of resistors coupled in series between the beginning terminal and the ending terminal;

the opamp includes a first input coupled to a reference voltage and a second input coupled between a first and a second one of the plurality of resistors.

11. The voltage supply regulator of claim 10, wherein the comparator includes a first input coupled to the reference voltage and a second input coupled between the second one of the plurality of resistors and a third one of the plurality of resistors.

12. The voltage supply regulator of claim 11, wherein the first regulator transistor is an NMOS transistor.

13. The voltage supply regulator of claim 11, wherein a resistance of the second one of the plurality of resistors is between 6 and 15 percent of a resistance of the third one of the plurality of resistors.

14. The voltage supply regulator of claim 8, wherein the slew rate detector includes a first diode and a second diode, the first diode having an input terminal coupled to the second terminal of the capacitor and an output terminal coupled to an input terminal of the second diode, and an output terminal of the second diode is coupled to the input terminal of the first diode and the second terminal of the capacitor.

15. The voltage supply regulator of claim 8, wherein the first, second, and pass transistors are PMOS transistors.

16. The voltage supply regulator of claim 8, wherein the second regulator transistor is an NPN bipolar junction transistor.

17. A voltage supply regulator, comprising:

a slew rate detector between control electrodes of two transistors in a current mirror, wherein inputs to the current mirror are coupled to an input voltage (VIN) and the slew rate detector includes:

a pair of diodes coupled back-to-back with one another;

a capacitor (18) including a first terminal coupled to the control electrodes of the two transistors in the current mirror, and a second terminal coupled to a first terminal of the pair of diodes;

a detection bipolar junction transistor including a collector coupled to the control electrodes of the first and second transistors in the current mirror, a base coupled to a second terminal of the capacitor and the first terminal of the pair of diodes, and an emitter coupled to a second terminal of the pair of diodes;

a current source coupled to a second current electrode of a first of the two transistors in the current mirror;

first, second and third resistors coupled in series;

a first regulator transistor having a collector coupled to a second current electrode of a second one of the two transistors of the current mirror, a base coupled to an output of a first opamp, and an emitter coupled to an output terminal of the third resistor.

18. The voltage supply regulator of claim 17, further comprising:

a pass transistor having:

a first current electrode coupled to respective first current electrodes of the two transistors of the current mirror and the input voltage, a control electrode coupled to the second current electrode of the second one of the two transistors of the current mirror, and a second current electrode coupled to a first terminal of the first resistor; and an output voltage terminal coupled to the second current electrode of the pass transistor.

19. The voltage supply regulator of claim 18, further comprising a first comparator, wherein:

the first opamp includes a first input coupled to a reference voltage and a second input coupled between the first and second resistors;

the first comparator includes a first input coupled to the reference voltage, a second input coupled between the second and third resistors, and an output coupled to a second regulator transistor; and the second regulator transistor further includes a first current electrode coupled to the output voltage terminal, a second current electrode coupled to ground.

* * * * *